United States Patent [19]

Kuroyanagi et al.

[11] Patent Number: 4,652,215

[45] Date of Patent: Mar. 24, 1987

[54] VARIABLE CAPACITY RADIAL PISTON PUMP

[75] Inventors: Masatoshi Kuroyanagi, Kariya; Masahiko Suzuki, Hoi; Kohichi Moriguchi, Nagoya; Kazuma Matsui, Toyohashi, all of Japan

[73] Assignee: Nippondenso Co., Ltd., Kariya, Japan

[21] Appl. No.: 721,391

[22] Filed: Apr. 9, 1985

[30] Foreign Application Priority Data

Apr. 12, 1984 [JP] Japan ..... 59-74411
May 23, 1984 [JP] Japan ..... 59-104929

[51] Int. Cl.[4] ..... F04B 1/06
[52] U.S. Cl. ..... 417/219; 92/12.1
[58] Field of Search ..... 91/497, 498; 417/219–221; 92/12.1

[56] References Cited

U.S. PATENT DOCUMENTS

| | | | |
|---|---|---|---|
| 2,506,974 | 5/1950 | Sorensen | 417/219 |
| 2,539,571 | 1/1951 | Deschamps | 91/497 X |
| 2,838,003 | 6/1958 | Joy | 91/497 X |
| 3,511,135 | 5/1970 | Ife et al. | 91/497 X |
| 3,756,749 | 9/1973 | Aldinger | 91/497 X |
| 3,782,245 | 1/1974 | Aldinger | 91/498 X |
| 3,784,328 | 1/1974 | Pedersen | 417/222 |

FOREIGN PATENT DOCUMENTS

| | | | |
|---|---|---|---|
| 202331 | 6/1956 | Australia | 91/497 |
| 2430119 | 1/1976 | Fed. Rep. of Germany | 91/491 |
| 2453736 | 5/1976 | Fed. Rep. of Germany | 91/497 |
| 337730 | 5/1959 | Switzerland | 91/497 |
| 109849 | 10/1917 | United Kingdom | 91/497 |

*Primary Examiner*—Carlton R. Croyle
*Assistant Examiner*—Paul F. Neils
*Attorney, Agent, or Firm*—Cushman, Darby & Cushman

[57] ABSTRACT

A variable capacity radial piston pump is disclosed, in which the radially outer ends of the pistons are constrained by engagement with the radially inner surface of a cam ring assembly that includes a radially inner ring, a radially outer ring, and rollable bearings between the inner and outer rings. The cam ring is shiftably mounted in the pump housing so that its magnitude of eccentricity relative to the pump rotor can be varied in order to vary the magnitude of suction and compression forces generated in the working fluid in the rotor chambers associated with the respective pistons. Several mechanisms for affecting the cam ring/rotor eccentricity variation are shown and described.

7 Claims, 25 Drawing Figures

VARIABLE CAPACITY RADIAL PISTON PUMP

FIELD OF THE INVENTION

This invention relates to a radial piston pump the volumes of working chambers of which can be varied. The radial piston pump of the present invention is useful as a power source for an automotive power steering system.

BACKGROUND OF THE INVENTION

A conventional type of radial piston pump is comprised of a rotor, a plurality of pistons slidably inserted in respective cylinders formed in the rotor, and a cam ring.

The cam ring of a conventional type pump is fixed with the pump housing so that the top portion (radially outer end) of each piston slides along the radially inner surface of the cam ring. In order to reduce friction, that conventional type pump employs a shoe provided between the top of each piston and the radially inner surface of the cam ring. However, the shoe causes a problem in that it resists flow of fluid in the pump. Therefore, the rotor of that conventional type pump cannot operate at as high a rotational speed as may be desired.

Also in the prior art a rotatably supported cam ring is disclosed for use in a vane-type pump, as described in Japanese laid-open utility model application No. 57-180184. However, since the cam ring of that vane-type pump is used for forming a working chamber, the clearance between the cam ring and a housing must be minimal in order to prevent leaking of fluid. Moreover, since the cam ring is supported by the housing, the cam ring cannot change its position for varying the volume of the working chamber.

SUMMARY OF THE INVENTION

An object of the present invention is to reduce the frictional resistance between the top portion of a piston and the radially inner surface of a cam ring without increasing the flow resistance of fluid in the pump. To that end, the pump of the present invention is provided with a cam ring which is comprised of an inner ring, an outer ring and rolling means provided between the inner and the outer rings.

Another object of the present invention is to prevent deformation of the cam ring.

To that end, the cam ring of the pump of the present invention is supported by supporting means.

A further object of the present invention is to vary the volume of the working chamber by moving the cam ring within the housing of the pump.

Another object of the present invention is to make the movement of the cam ring smooth. To achieve this object, the cam ring of the pump of the present invention preferably has a connecting means so constructed and arranged that the fluid in the housing can escape through the connecting means.

Another object of the present invention is to prevent undesirable vibration of the cam ring by supporting the cam ring by spring means.

A further object of the present invention is to remove particulate debris from the fluid in the pump. To that end, the pump of the present invention preferably has a particulate debris removing filter means provided in the housing thereof. In particular, the pump of the present invention may employ a magnet within the housing in order to remove fine particulate metallic debris.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION OF THE PRESENTLY PREFERRED EMBODIMENTS

Figure 1:
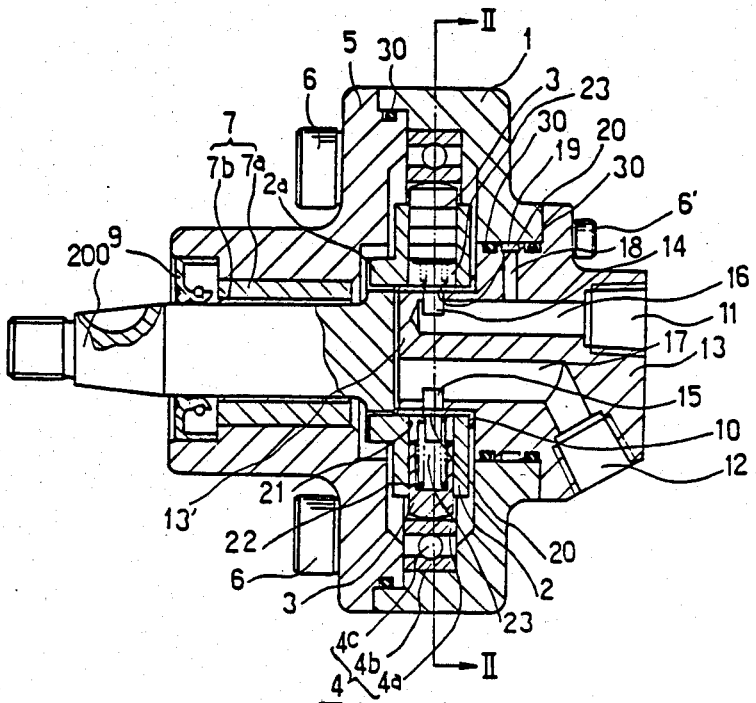
FIG. 1 is a longitudinal cross-sectional view of a radial piston pump according to a first embodiment of the present invention.

Numeral 1 in FIG. 1 designates a housing, and numeral 2 designates a rotor rotatably supported within the housing 1. The rotor 2, as shown, has seven radially arranged cylinders 21, and each cylinder 21 employs a piston 3 in such manner that the piston can slide along the longitudinal axis of the respective cylinder, but the clearance between the radially inner surface of the cylinder 21 and the radially outer surface of the piston is so slight that fluid leakage there between is prevented. The rotor 2 has a coupling portion 2*a* at the left end thereof (in FIG. 1), and a drive shaft 200, which is constructed and arranged to be rotated by a power source, e.g. an automotive engine (not shown) or an electric motor (not shown), is connected with the coupling portion 2*a*, so that the rotor rotates simultaneously with the drive shaft 200. The drive shaft 200 is supported by a front housing 5, which is fixed with the housing 1 by bolts 6, via bearing 7. The bearing is shown being a journal bearing comprising a supporting ring 7*a* which is tightly inserted into the inner hole of the front housing 5 and a slip ring 7*b* on which the drive shaft 200 is rotatably supported. Numeral 9 indicates an oil seal which prevents leakage of the fluid flowing through the bearing 7.

The numeral 13 designates a rear housing fixed with the housing 1 by bolts 6'. The rotor 2 is rotatably mounted on the shaft portion 13' of the rear housing 13 via a slip ring 10 which is tightly inserted into the center hole of the rotor 2. The slip ring 10 is made of somewhat slippery metal such as phosphor bronze, and has connecting ports 20 at the corresponding positions with the cylinder 21. Since the diameter of each connecting port 20 is smaller than that of the respective cylinder 21, a spring 22 located in the cylinder 21 is supported by the slip ring 10.

Figure 2:
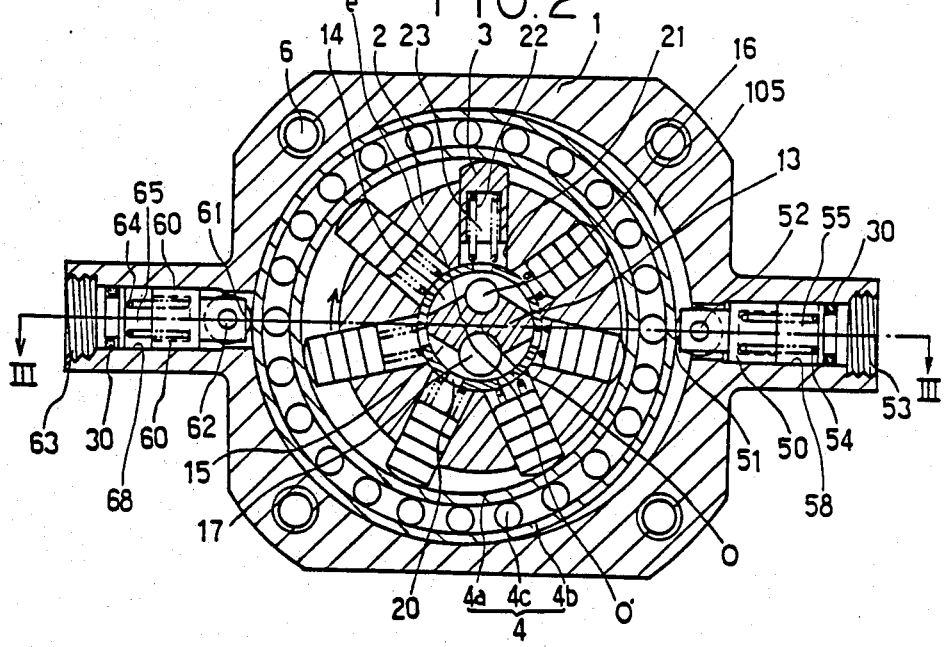
FIG. 2 is a transverse cross-sectional view of the radial piston pump taken along the line II—II of FIG. 1.
Figure 3:
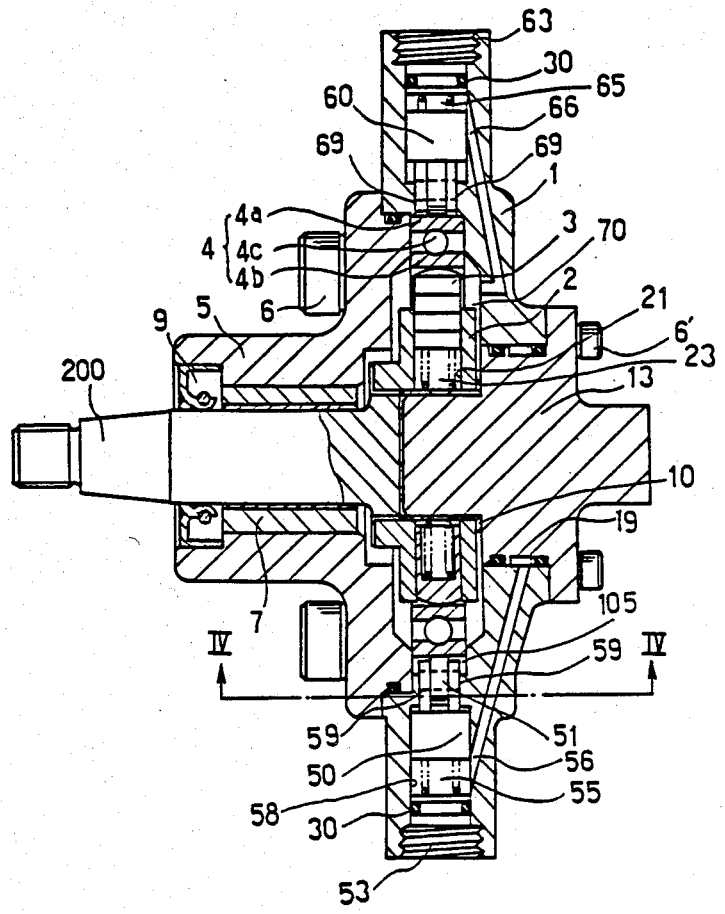
FIG. 3 is a longitudinal cross-sectional view of the radial piston pump taken along the line III—III of FIG. 2.

The top portion of each piston 3 is generally spherically domed and protrudes from the respective cylinder 21 due to the expanding force provided by the respective spring 22, so that the generally spherically domed top portion of the piston is contacted with an inner ring 4*a* of a cam ring 4. The cam ring 4 is comprised of the inner ring 4*a*, an outer ring 4*b* which is supported by the inner surface of the housing 1 and rolling balls 4*c* which are held between the outer and inner rings 4*b* and 4*a*. Therefore, the inner ring 4*a* rotates approximately at the same speed as the rotation of rotor 2, and the rolling balls 4*c* revolve about half that speed. The longitudinal axis O' of the cam ring 4 is eccentric in relation to the longitudinal axis O of the rotor 2. Therefore, the amount of the top portion of each piston 3 protruding from the respective cylinder is changed in accordance with the rotation of the rotor 2. Accordingly, each working chamber 23 formed by a cylinder 21 and the bottom portion of the respective piston 3 changes its volume. As shown in FIG. 2 the working chambers 23 in the bottom half of the pump are under a suction condition and the working chambers 23 in the top half of the pump are under a discharging condition. A suction connecting port 12, a suction path 17 and a suction groove 15 are formed in the bottom half of the rear housing 13 so that the suction groove 15 is connected with the working chamber 23 under suction condition via the connecting port 20 formed in the slip ring 10. A discharge connecting port 11, a discharge path 16 and a discharge groove 14 are formed in the top half of the rear housing 13 so that the discharge groove 14 is connected with the working chamber 23 under discharge condition via the connecting port 20. The numeral 19 designates an annular groove formed at the outer surface of the rear housing 13 and connecting with the discharge path 16 through a connecting hole 18.

The numeral 51 of FIG. 2 indicates a supporting roller for supporting the outer ring 4*b* in such a manner that the outer ring 4*b* can rotate while being supported by the supporting roller 51. The supporting roller 51 is rotatably held with a holding portion 52 of a first control piston 50. The first control piston 50 is held in a first cylinder 58 in such manner that the piston 50 can slide along the longitudinal axis of the cylinder 58 but the clearance between the outer surface of the piston 50 and inner surface of the cylinder 58 is tight enough to prevent leaking of the fluid in a control chamber 55 which is defined by the cylinder 51, the piston 50 and a cap 53 screwed onto the housing 1. The control chamber 55 is connected with the annular groove 19 via a first connecting port 56 for receiving the high pressure of the discharge fluid. The numeral 30 designates an O-ring for preventing leakage through the cap 53, and the numeral 54 indicates a spring for forcing the supporting roller 51 toward the outer ring 4*b*.

Figure 4:
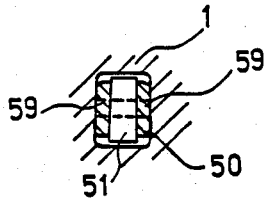
FIG. 4 is a fragmentary transverse cross-sectional view of the supporting portion of the control cylinder taken along the line IV—IV of FIG. 3.
Figure 5:
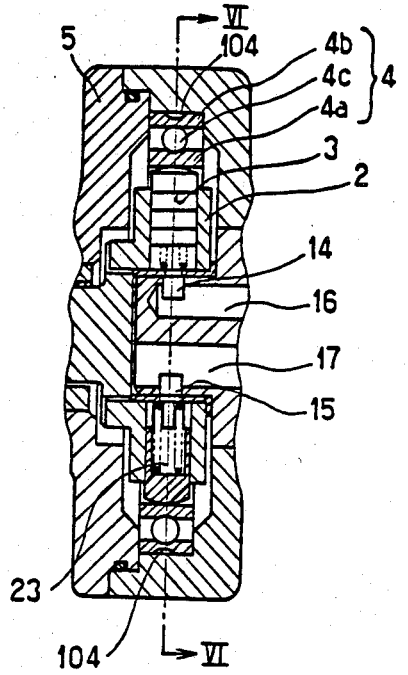
FIG. 5 is a fragmentary longitudinal cross-sectional view showing the rotor portion of a pump according to a second embodiment of the present invention.

At the opposite side of the housing 1, a second piston 60 having a holding portion 62 for holding a supporting roller 61 is slidably held in a second cylinder 68. The supporting roller 61 is also forced towards the outer ring 4*b* by the expanding force of a spring 64 which is held between the second piston 60 and a cap 63. A second control chamber 65 which is defined by the second piston 60, the second cylinder 68 and the cap is connected with an inner chamber 70 of the pump via a second connecting port 66. The inner chamber 70 is also connected with the suction connecting path 17, therefore, the pressure of the fluid in the inner chamber 70 is sufficiently low as to cause suction. The side faces 59 and 69 of the holding portions 52 and 62 face the inner surface of the cylinder 58 and 68 so that the side faces 59 and 69 can slide on the inner surface of the cylinder 58 and 68, in order to prevent the pivoting of the supporting rollers 51 and 61, as shown in FIG. 4.

Hereinafter, the operation of the above described pump is explained.

Since the central axis O of the rotor 2 is eccentric with that O' of the cam ring 4, the piston 3 reciprocates along the cylinders 21 when the rotor 2 rotates. During the suction condition of each working chamber 23, as shown in the bottom half of FIG. 2, working fluid is sucked into each working chamber 23 through suction connecting port 12, the suction path 17, the suction groove 15 and the connecting port 20. During the discharge condition of each working chamber 23, the fluid in that working chamber 23 discharges toward the discharge connecting port 11 through the connecting port 20, the discharge groove 14 and the discharge path 16.

The volume of each working chamber 23 can be changed by sliding the cam ring 4. In particular, when the cam ring 4 stays at its left end position, shown in FIG. 2, the distance e between the both central axis O and O' is at a maximum and therefore, the reciprocating stroke of the respective piston 3 is maximized. On the other hand, when the cam ring 4 is slid towards the right side in FIG. 2, the reciprocating stroke of the respective piston 3 is reduced so that the volume of the respective working chamber 23 is reduced.

Accordingly, during the period before the discharge pressure of the pump becomes high, the position of the cam ring 4 is determined by the expanding force of the first and second springs 54 and 64, which are shown having a right side position in FIG. 2.

Since the first control chamber 55 is under the discharge pressure and the second control chamber 65 is under the suction pressure, the cam ring 4 moves towards the left side in FIG. 2 in accordance with increasing of the discharge pressure. Accordingly, the distance e between the central axis O and O' increases gradually, which causes the volume of the working chambers 23 to become larger.

Since the cam ring 4 is pressed upwardly in FIG. 2 due to high pressure in the respective working chamber 23 under the discharge condition, the pressing strength caused between the top side, in FIG. 2, of the outer ring **4*b* and the inner surface of the housing 1 is much stronger than that between the bottom side of the outer ring 4*b* and the inner surface of the housing 1. Therefore, the outer ring 4*b* does not slide but rotates within the housing 1 when the cam ring 4 moves. It is noted that since the outer ring 4*b* is supported by the rollers 51 and 61, the rotation of the outer ring 4*b* is accomplished smoothly. In other words, the response of the movement of the cam ring 4 is quick. According to the present inventors' experience, the responding time, that is the time period from the inputting time when the control signal which cause the cam ring 4** move is inputted, to the conclusion of the time when the amount of the discharge fluid is changed completely, is only from several milliseconds to several tens of milliseconds.

Moreover, since the cam ring does not define the working chamber 23, the clearance between the cam ring 4 and the front housing 5 and the housing 1 does not have to be slight. In other words, the cam ring of the present embodiment can stay in the inner chamber 70. Therefore, the cam ring 4 of the present invention can rotate within the inner chamber 70 with no frictional resistance caused at the side faces of the cam ring 4.

Furthermore, since the top portion of the piston each 3 is formed spherically, the flow resistance caused by the fluid around each piston 3 is quite low even when the rotor 2 and the pistons 3 rotate fast within the inner chamber 70. Since the revolving speed of the balls **4*c* is about half the rotating speed of the inner ring 4*b***, the flow resistance caused by the fluid around the balls is also low. Therefore, the total resistance including flow resistance and frictional resistance remains low.

Figure 6:
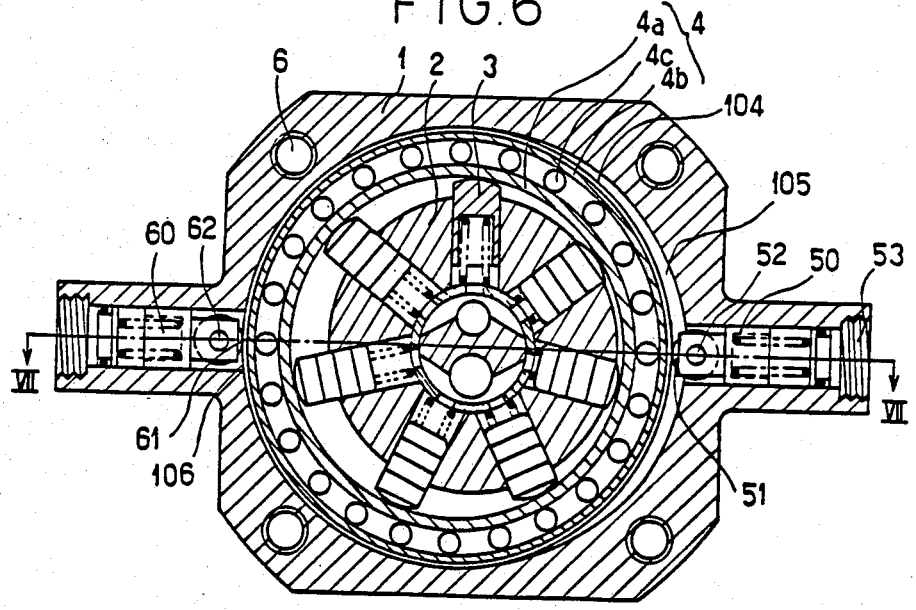
FIG. 6 is a transverse cross-sectional view of the second embodiment of the radial piston pump, taken along the line VI—VI of FIG. 5.

Hereinafter, the second embodiment of the present invention is explained. The second embodiment of the pump has an annular groove 104 on the outer surface of the outer ring **4*b* of the cam ring 4 in order to make the fluid in the closed space 105 (shown in FIG. 6) formed between the housing 1 and the outer ring 4*b* escape from the space 105 so that the cam ring 4 can rotate easily within the space 105. Namely, since the fluid in the space 105 can flow through the annular groove 104 of the outer ring 4*b* to the space 106 of opposite side (shown in FIG. 6), the resistance caused by the fluid in the space 105 when the outer ring 4*b* rotates from the left side to the right side in FIG. 6** can be reduced.

Figure 7:
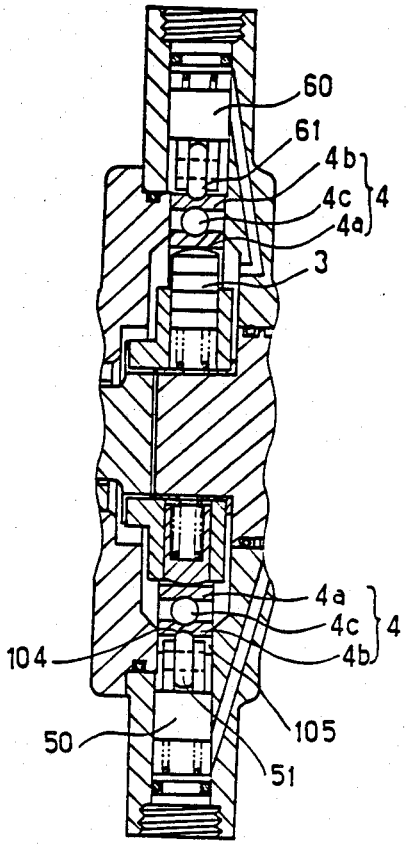
FIG. 7 is a fragmentary longitudinal cross-sectional view showing the rotor portion and the control pistons of the second embodiment of the pump, taken along the line VII—VII of FIG. 6.

Furthermore, because the first and the second rollers 51 and 61 can be inserted into the annular groove 104, as shown in FIG. 7, pivoting of the first and the second pistons 50 and 60 is substantially prevented. Therefore, the holding portions 52 and 62 of the pistons 50 and 60 do not have to slide on the inner surface of the housing 1 as shown in FIG. 4. Accordingly, the housing 1 and the pistons 50 and 60 of the second embodiment can be made more easily than those of the first embodiment.

Figure 8:
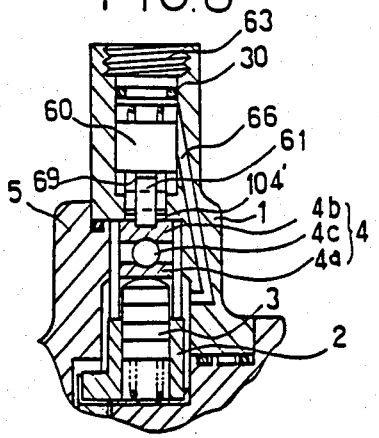
FIG. 8 is a fragmentary longitudinal cross-sectional view showing the cam ring of a pump according to a third embodiment of the present invention.

FIG. 8 shows the third embodiment of the present pump, which has a rectangularly-shaped annular groove 104' in the outer ring **4*b* and the same rectangularly-shaped annular convex rib (not shown) on the inner surface of the housing 1, so that the annular convex rib can be inserted into the annular groove 104'. Therefore, the horizontal slipping in FIG. 8 of the outer ring 4*b* can be substantially prevented. Accordingly, the both sides of the outer ring 4*b* do not have to face to the housing 1 or the front housing 5. In such a case, not only the inner ring 4*a* and the balls 4*c*, but also the outer ring 4*b* can be located within the inner chamber 70. In other words, the pump of the third embodiment does not have closed space 105 and 106, so the outer ring 4*b*** can move in the housing quite easily.

Figure 9:
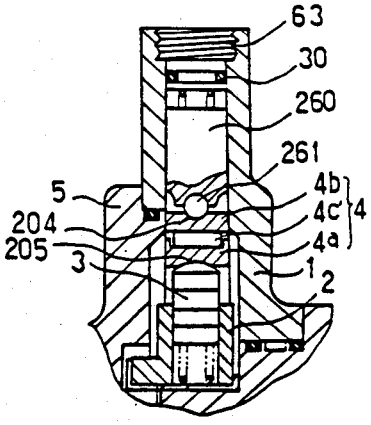
FIG. 9 is a fragmentary longitudinal cross-sectional view showing the cam ring of a pump according to a fourth embodiment of the present invention.

FIG. 9 shows the fourth embodiment of the present pump, which employs needle rollers **4*c'* instead of the balls 4*c* and supporting balls 261 instead of the first and second rollers 51 and 61. The supporting balls 261 fit in an annular groove 204 formed in the outer surface of the outer ring 4*b***.

The inner ring **4*a* of this embodiment has a spherically shaped receiving groove 205 in which the top portion of the piston 3** fits.

Figure 10:
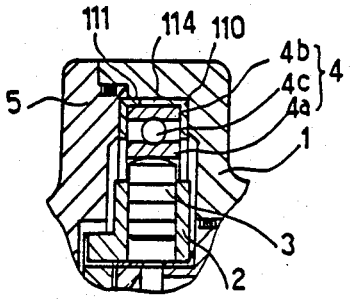
FIG. 10 is a fragmentary longitudinal cross-sectional view showing the supporting ring of a pump according to a fifth embodiment of the present invention.
Figure 11A:
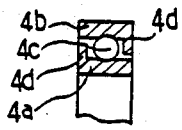
FIGS. 11(*a*)-11(*i*) are respective fragmentary longitudinal cross-sectional views showing other variations of the supporting ring of a pump according to the fifth embodiment of the present invention.
Figure 11B:
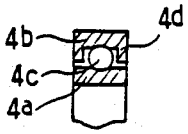
Figure 11C:
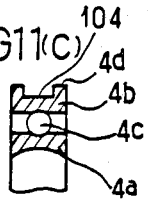
Figure 11D:
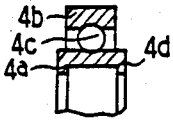
Figure 11E:
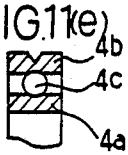
Figure 11F:
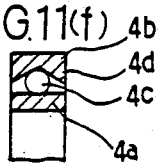
Figure 11G:
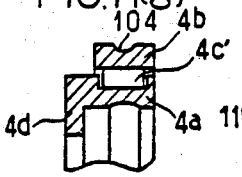
Figure 11H:
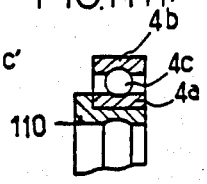
Figure 11I:
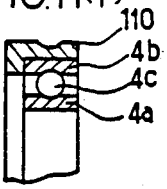

FIG. 10 shows the fifth embodiment of the present pump, which employs supporting rings 110 and 111 at the outer surface of the outer ring **4*b*. The supporting rings 110 and 111 are made of metal having a high young's modulus and a thickness of several millimeters. The two supporting rings 110 and 111 form an annular groove 114 between them, which functions in the same manner as the annular groove 104** of the second embodiment.

According to the results of experimentation by the present inventors, the cam ring 4 is deformed about 0.5 mm by the high pressure of the discharge fluid when a normal bearing specified by the relevant Japan Industry Standard is used as the cam ring 4. Namely, the high pressure in each working chamber 23 is transmitted to the cam ring through the pistons 3 and cause the cam ring 4 to assume an oval shape. The supporting rings 110 and 111 prevent this deforming of the cam ring 4.

Figure 14:
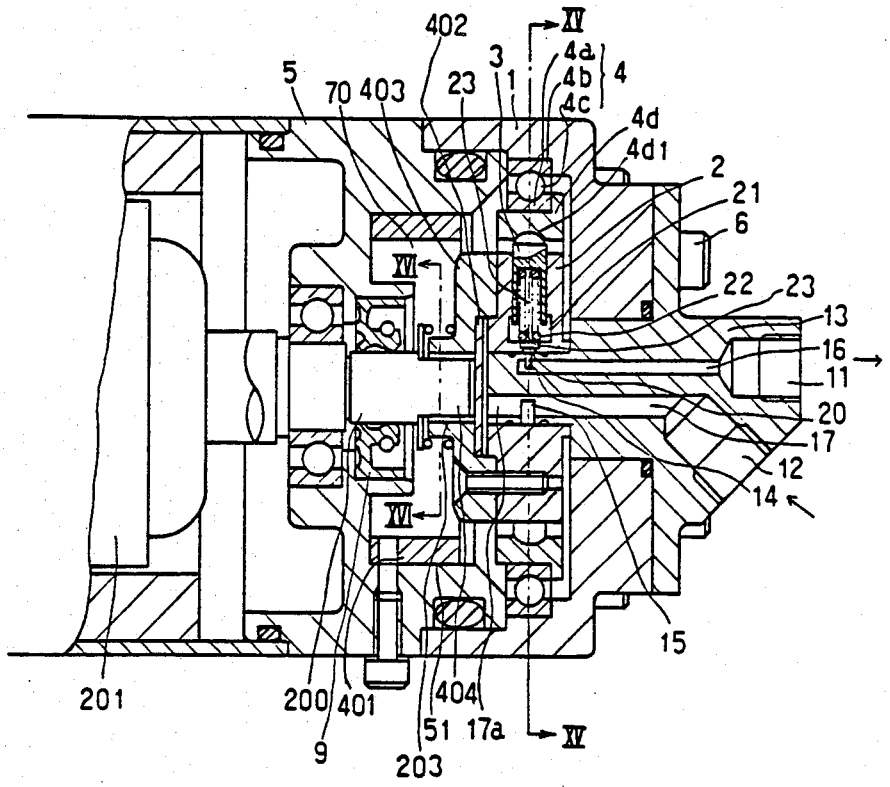
FIG. 14 is a longitudinal cross-sectional view of a radial piston pump according to a seventh embodiment of the present invention.
Figure 15:
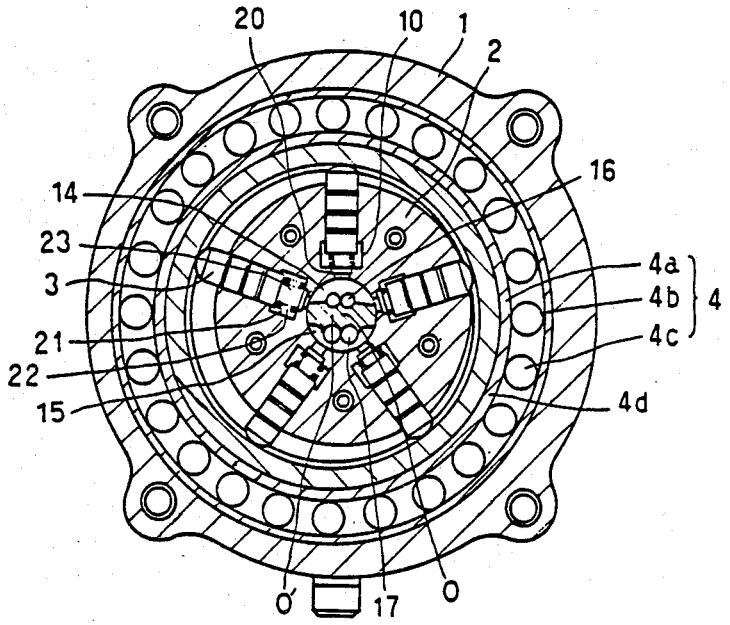
FIG. 15 is a transverse cross-sectional view of the seventh embodiment of the radial piston pump, taken along the line XV—XV of FIG. 14.
Figure 16:
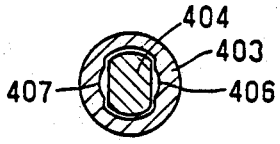
FIG. 16 is a transverse cross-sectional view showing the coupling plate of the pump, taken along the line XVI—XVI of FIG. 14.

FIGS. **11(*a*)–11(*g*) show other possible variations of the supporting rings, but the supporting rings 4*d* of these variations are integrally made from the cam ring 4. These designs, in which the supporting rings 4*d* are integrally made from the cam ring 4 have a projection that makes it easy to assemble the cam ring 4. In the design shown in FIG. 11(*c*), the annular groove 104 is provided between two of the supporting rings 4*d* and also has spherically shaped groove 205 in the inner ring 4*a* for fitting with the top portions of the pistons 3. The designs shown in FIGS. 11(*a*), (*b*) and (*f*) have the supporting rings 4*d* protruding inwardly from the inner ring 4*a* or the outer ring 4*b*. FIGS. 11(*h*) and (*i*) show other variations using a normal bearing. The supporting ring 110 is tightly inserted into the inner-surface of the cam ring 4 (shown in FIG. 11(*h*)), or FIGS. 14–16 show the seventh embodiment of the present invention, which employs filter means 401 and 402** for removing particulate debris within the fluid in the pump.

The numeral 403 shows a coupling plate which is fixed with the left end (in FIG. 14) of the rotor and has a center hole 405 in which the right end 404 (in FIG. 14) of the drive shaft 200 is tightly held. Namely, the sectional shape of the center hole 405 is approximately rectangular, and same sectionally shaped drive shaft 200 is tightly inserted there into, as shown in FIG. 16. The coupling the supporting ring 110 tightly holds the outer surface of the cam ring 4 (shown in FIG. **11(*i*)**).

Figure 12:
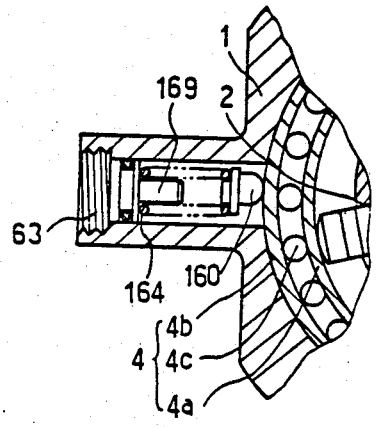
FIG. 12 is a fragmentary transverse cross-sectional view showing the supporting spring portion of a pump of the sixth embodiment of the present invention.

FIG. 12 shows the sixth embodiment of the present invention, which eliminates the second piston 60 of the first embodiment. Since the cam ring 4 is received the counter force which forces the cam ring 4 toward such a direction that the distance e between the central axes O and O' is reduced, e.g., toward the right in FIG. 2, the cam ring 4 can be moved without the second piston 60. Nevertheless, since the counter force is changed frequently with the frequency being related to the number of the piston 3, the counter force would make the cam ring 4 vibrate finely. Therefore, the sixth embodiment employs a pressure pin 160 in order to prevent the fine vibration of the cam ring 4. The pressure pin 160 is protruded towards the cam ring 4 by the expanding force of the spring 64 the end of which is supported by a convex portion 169 integrally protruding from the cap 63.

Figure 13:
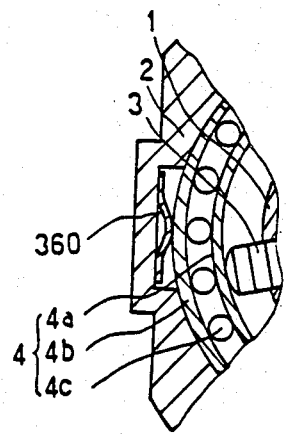
FIG. 13 is a fragmentary transverse cross-sectional view showing another variation of the supporting spring portion of the pump of the sixth embodiment of the present invention.

FIG. 13 shows another variation of the sixth embodiment which employs a leaf spring 360 instead of the coil spring 64 and the pressure pin 160.

Plate 403 also has notches 406 and 407 in the inner surface of the center hole so that the fluid in the inner chamber 70 defined between the housing 1 and the front housing 5 can flow into the suction path 17 through the notches 406 and 407.

The numeral 402 indicates a filter element held between the rotor 2 and the coupling 403. Namely, between the inner chamber 70 and the suction path 17. Therefore, the particulate debris in the inner chamber 70, such as fine metallic dust generated by the friction between the metal elements, for example between the rotor 2 and the piston 3 or between the piston 3 and the cam ring 4, during the operation of the pump, is removed by the filter element 402 when the fluid in the inner chamber 70 flows toward the suction path 17. In other words, it is substantially prevented that the particulate debris generated in the pump flows into a working chamber 23 through the suction path 17. It is noted that the center portion of the filter element 402, namely the portion on which the suction path faces, can always be kept clean, because the dust deposited in the filter element 402 is moved outwardly by the centrifugal power caused by the rotation of the filter element 402. A foam metal filter, a metal fiber filter, a paper filter or such other equivalent structure is suitable for use as the filter element 402.

The numeral 401 in FIG. 14 indicates a magnetic element fixed with the inner surface of the front housing 5, so that the inner surface of the magnetic element 401 directly faces the inner chamber 70. Therefore, the shape of the magnetic element 401 is cylindrical in order to reduce the flow resistance of the flow of the fluid in the inner chamber 70. Since the rotor 2 rotates in the inner chamber 70, the fluid in the inner chamber 70 flows with the same direction as the rotation of the rotor 2. Therefore, the particulate metallic debris in the fluid is moved outwardly by the centrifugal force caused by the fluid flows. Then the particulate metallic debris is caught by the magnetic element 401. Accordingly, the particulate metallic debris generated in the inner chamber 70 is removed from the fluid efficiently.

Though the magnetic element 401 of this embodiment is constituted by a permanent magnet, the magnetic element 401 is of course constituted by an electric magnet, and also the magnet of the electric motor 201 can be used as the magnetic element 401. Furthermore, the shape of the magnetic element 401 can be changed to other than a cylindrical shape.

Figure 17:
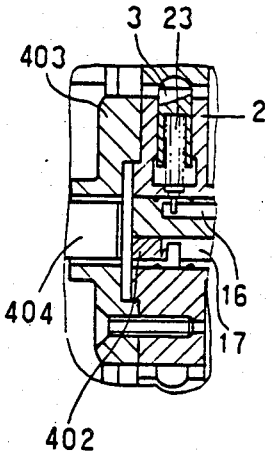
FIG. 17 is a fragmentary longitudinal cross-sectional view showing the filter of another variation of the seventh embodiment of the pump of the present invention.

FIG. 17 shows other variations of the sixth embodiment of the present pump. As shown in this FIG. 17, the filter element 402 can be located in the suction path 17.

What is claimed is:

. 1. A variable capacity radial piston pump, comprising:

a housing;

a drive shaft rotatably supported by said housing;

a rotor rotatably supported in said housing and connecting with said drive shaft so that said rotor is constructed and arranged to be rotated by said drive shaft;

at least one cylinder radially formed in said rotor;

a piston slidably inserted in each said cylinder so that a working chamber is formed between a bottom portion of each said piston and the respective said cylinder;

a cam ring comprising:

an inner ring provided around said rotor in such manner that a top portion of each said piston is restrainingly contacted by a radially inner surface of said inner ring;

an outer ring provided within said housing in such manner that said outer ring can move within said housing, said outer ring circumferentially surrounding said inner ring; and a rolling means provided radially between said inner ring and said outer ring so that said inner ring is able to rotate indirectly against said outer ring;

said cam ring having a longitudinal axis which is eccentrically disposed in said housing relative to that of said rotor;

a controlling means associated with said cam ring within said housing for controlling the magnitude of eccentricity between said cam ring and said rotor;

said controlling means including:

a first controlling piston contacting said outer ring of said cam for moving said cam ring within said housing;

a second controlling piston contacting said outer ring of said cam ring for moving said cam ring within said housing;

said first controlling piston and said second controlling piston being located in a common plane with the longitudinal axis of said rotor and said cam ring;

a first supporting roller rotatably held by said first controlling piston and contacting said outer ring of said cam ring for transmitting movement of said first controlling piston to said cam ring; and a second supporting roller rotatably held by said second controlling piston and contacting said outer ring of said cam ring for transmitting movement of said second controlling piston to said cam ring;

said outer ring of said cam ring having means defining an annular groove in a radially outer surface thereof, and said first supporting roller and said second supporting roller fitting with said annular groove.

2. A variable capacity radial piston pump as claimed in claim 1, wherein:

said first controlling piston is constructed and arranged to be moved by discharge pressure from said working chamber; and said second controlling piston is constructed and arranged to be moved by suction pressure from said working chamber, so that said first controlling piston and said second controlling piston control said magnitude of eccentricity in accordance with the operation of said variable capacity radial piston pump.

3. A variable capacity radial piston pump as claimed in claim 1, wherein:

means defining an annular groove in a radially outer surface of said outer ring is so constructed and arranged that fluid within said housing is able to flow through said annular groove.

4. A variable capacity radial piston pump as claimed in claim 1, wherein:

the said annular groove is of rectangular transverse cross-sectional shape.

5. A variable capacity radial piston pump as claimed in claim 1, wherein:

said outer ring of said cam ring has a side face which is spaced apart from said housing.

6. A variable capacity radial piston pump as claimed in claim 1, wherein:

the said inner ring of said cam ring has a side face which is spaced apart from said housing.

7. A variable capacity radial piston pump as claimed in claim 1, wherein:

said rolling means of said cam ring comprises a plurality of rolling balls.

* * * * *